US008459871B2

(12) United States Patent
Samadijavan et al.

(10) Patent No.: US 8,459,871 B2
(45) Date of Patent: Jun. 11, 2013

(54) SHIPPING BAG AND METHOD OF MAKING A REINFORCED SELVAGE

(76) Inventors: Amir Samadijavan, Vienna (AT); Karl Schmitt, Traisen (AT); Arpad Tauber, Wals (AT); Maria Luca, Kreis Satu-Mare (RO)

( * ) Notice: Subject to any disclaimer, the term of this patent is extended or adjusted under 35 U.S.C. 154(b) by 281 days.

(21) Appl. No.: 12/886,628

(22) Filed: Sep. 21, 2010

(65) Prior Publication Data

US 2011/0142378 A1 Jun. 16, 2011

(30) Foreign Application Priority Data

Sep. 21, 2009 (AT) ..... A 1484/2009

(51) Int. Cl.

| | |
|---|---|
| ***B65D 30/04*** | (2006.01) |
| ***B65D 30/00*** | (2006.01) |
| ***B29D 22/00*** | (2006.01) |
| ***D03C 11/00*** | (2006.01) |
| ***D03C 1/04*** | (2006.01) |
| ***D03C 47/40*** | (2006.01) |

(52) U.S. Cl.
USPC ..... 383/117; 383/107; 428/36.1; 139/54; 139/389; 139/430

(58) Field of Classification Search
USPC ..... 383/117, 107, 105; 428/36.1, 36.2, 428/193, 157; 139/54, 430–434, 195, 38 R, 139/385, 387 R, 388–390; 442/203
See application file for complete search history.

(56) References Cited

U.S. PATENT DOCUMENTS

| | | | | |
|---|---|---|---|---|
| 1,576,191 | A * | 3/1926 | Jelleme | 139/389 |
| 1,986,491 | A * | 1/1935 | Wilson | 112/405 |
| 3,340,919 | A * | 9/1967 | Holbrook | 383/117 |
| 3,470,928 | A * | 10/1969 | Schwartz | 383/117 |
| 4,207,937 | A * | 6/1980 | Sandeman et al. | 383/17 |
| 4,307,764 | A * | 12/1981 | Nattrass | 383/17 |
| 4,646,357 | A * | 2/1987 | Nattrass | 383/20 |
| 4,800,929 | A * | 1/1989 | Watanabe | 139/383 R |
| 5,759,462 | A * | 6/1998 | Jordan | 264/105 |
| 5,851,638 | A | 12/1998 | Lagemann | |
| 6,632,753 | B1 * | 10/2003 | Beasley, Jr. | 442/203 |
| 6,675,837 | B1 * | 1/2004 | Russ et al. | 139/11 |
| 7,178,559 | B2 | 2/2007 | Tielemans | |
| 7,179,762 | B1 * | 2/2007 | Beasley, Jr. | 442/203 |
| 2003/0114055 | A1 * | 6/2003 | Burton et al. | 442/31 |

FOREIGN PATENT DOCUMENTS

| | | | |
|---|---|---|---|
| AT | 010526 | U | 5/2009 |
| DE | 2340817 | A | 2/1975 |
| JP | 10236253 | A * | 9/1998 |

* cited by examiner

*Primary Examiner* — Jes F Pascua
(74) *Attorney, Agent, or Firm* — Andrew Wilford

(57) ABSTRACT

A flexible shipping bag is comprised of at least one panel having edges. The panel is formed of weft and warp filaments and has a central region of predetermined full thickness and a selvage forming at least one of the respective edges and of a lesser thickness. The warp filaments in the central region are thicker than the warp filaments in the selvage.

21 Claims, 5 Drawing Sheets

SHIPPING BAG AND METHOD OF MAKING A REINFORCED SELVAGE

FIELD OF THE INVENTION

The present invention relates to a shipping bag. More particularly this invention concerns a method of making a reinforced selvage, in particular for manufacturing a shipping bag.

BACKGROUND OF THE INVENTION

The invention relates to a flexible shipping bag formed by sewing together edges of at least one textile panel having a full-thickness region as well as warp and weft filaments, and along at least one of the selvages of the textile panel is provided with a partial-thickness region. The invention further relates to a method for producing a reinforced selvage of a is textile web.

In the production of a so-called "big bag" or "FIBC" (Flexible Intermediate Bulk Container), a flexible woven textile is generally used. Such textile woven materials are known, and can be produced on flat or circular weaving looms. Accordingly, one refers to flat or circular woven material. Woven material produced in this way has the generally known weaving pattern with crossing weft and warp filaments. However, the actual weave used has minimal bearing on the present invention.

In the production of the above-described shipping bag, textile panels of the textile woven material have to be sewn together. Taking into account that the shipping bags are designed to withstand considerable stress of for example 1000 kg to 5000 kg, it is obvious that the textile panels being used must be highly resistant to the woven material ripping at the seams. For this reason, it is known to provide the textile woven material being used with reinforced selvages.

If the textile woven material is produced on a flat loom, it is known to create a so-called Sulzer edge. The weft filaments are thereby folded over and then inserted into the produced woven material. However, this is an expensive and is comparatively slow process; moreover, flat looms are generally more expensive than circular weaving looms.

It is known to produce textile panels of a desired width from circular woven material by cutting the circular woven material open with a continuous longitudinal cut extending parallel to the warp. In this method, all the weft filaments of the circular woven material are separated in one line. It is not possible in this case to produce a Sulzer edge. In order to reinforce the selvages thus produced, the woven material is folded over at the edge and is fastened by a seam or ultrasound welding. However, this frequently applied solution has several disadvantages. To start with, this procedure requires additional material, typically up to 8 percent of the woven material width, thus rendering the production more expensive. A further problem occurs when the produced textile panels are rolled up. Due to doubling of the material thickness at the selvages of the textile panels, handling the produced rolls of textile panels is made harder.

U.S. Pat. No. 7,178,555 describes a method for manufacturing a belt having warp filaments and at least one weft filament, wherein one method step comprises the shrinking of the warp filaments in the central area of the woven material. U.S. Pat. No. 5,851,638 further describes a woven material for reinforcing, or armoring sheet-like structures of weft and warp filaments, forming open spaces with one another. Adjoining a basic woven material is an edge where the weft filaments and/or the warp filaments are reinforced. The purpose of this device is the mechanical reinforcement of the woven material being produced. Furthermore, DE 2 340 817 A1 discloses a method for reinforcing the selvages of woven materials with separate weft filament ends. The above-mentioned forming of a raised edge welt is not recognized in this publication as a problem to be solved.

Another known solution is to weld the exposed warp and weft filaments in the border area with an ultrasound welding device. However, it was found that such a welded border area does not have the required strength, and that the applied welding energy has to be regulated with great precision in order to avoid damaging the woven material.

An additional solution is known from design patent AT 010 526 U1 that proposes the removal or omission of warp filaments from the selvage area during manufacture of the woven material, thus creating a partial-thickness region. By cutting the textile panel along this area, free-hanging weft filaments are created that are folded over the full-thickness region using suitable devices, and are glued to, or welded to the already produced woven material. In this way, a comparatively solid selvage is achieved and the formation of a raised edge when the woven material is rolled up is significantly reduced.

However, it has been found that the selvage areas thus formed are of a strength that is still significantly below that of a Sulzer selvage. Moreover, in practice the handling of free-hanging weft filaments is problematic.

OBJECTS OF THE INVENTION

It is therefore an object of the present invention to provide an improved shipping bag and method of making a reinforced selvage.

Another object is the provision of such an improved shipping bag and method of making a reinforced selvage that overcomes the above-given disadvantages, in particular that can be made on a circular loom with a continuous longitudinal cut, having a selvage that on the one hand is provided with a strength comparable to that of the known Sulzer selvage, and on the other hand forms at most very low raised edges when the textile panel is rolled up.

SUMMARY OF THE INVENTION

A flexible shipping bag according to the invention is comprised of at least one panel having edges. The panel is formed of weft and warp filaments and has a central region of predetermined full thickness and a selvage forming at least one of the respective edges and of a lesser thickness. The warp filaments in the central region are thicker than the warp filaments in the selvage.

Due to the fact that in the partial-thickness region the warp filaments are of reduced thickness, the partial-thickness region is considerably thinner than the full-thickness region. However, no fringe is formed as with in above-cited AT 010 526, rather, the woven material remains cohesive. Subsequently, the partial-thickness region is folded over the full-thickness region, in part or entirely, and can be fastened thereto using a hot melt adhesive, an adhesive, a coating, or a welding method such as hot welding, laser welding, or ultrasound welding.

As mentioned above, the entire partial-thickness region or parts thereof can be folded over the full-thickness region. If the entire partial-thickness region is folded over the full-thickness region, the resulting selvage is particularly robust. As in the described conventional methods, a raised edge is formed when the textile panel is rolled up; it is, however, considerably thinner. The formation of such a raised edge can be avoided by folding only part of the partial-thickness region over the full-thickness region, or, as will be described below, the partial-thickness region is folded over itself by folding it on its centerline. In this instance, no raised edge is formed.

For example, the partial-thickness region has a width of 4 cm during weaving and is centrally subdivided by a continuous longitudinal cut, thus creating on each edge a partial-thickness selvage area of about 2 cm that can be folded over in its entirety. The longitudinal cut can also be done at any other point of the partial-thickness region, in order to obtain asymmetrical selvages, for example, without going outside the invention. Typical measurements of the reinforced selvage are in the range of 1 to 3 cm, preferred widths of the selvages being about 1.5 cm to about 2.5 cm.

In order to keep the goods shipped in the shipping bag from coming into contact with the woven material, that is, to protect the woven material from the goods being shipped, the invention provides a coating on at least one side the textile panel, preferably on the inner faces of the panels making up the shipping bag, covering the entire surface of the textile panel, including the reinforced selvage. The invention particularly provides for the application of the coating in the inner face of the shipping bag so that the pressure of the goods inside the bag does not loosen the coating from the woven material. Coating the outer side of the shipping bag is however advisable in order to protect the woven material from ambient influences. The coating can be of a synthetic material, or specifically, can be of the material of the textile panel, in order to allow the disposal of the shipping bag together with the coating. Otherwise, the coating can be adapted to the intended use, for example, to provide resistance to water, acids, or static electricity. A further provision of the invention is that the coating can form a flange projecting past an edge of the textile panel, particularly to provide protection for the folded- or bent-over selvage.

The invention further provides that the shipping bag is produced by the sewing together of the textile panels at a seam formed in the full-thickness region inward of the reinforced selvages. The invention particularly provides for the seam to be placed about 17 mm to 25 mm from the outer edge of the selvage of the woven material.

The warp and/or weft filaments provided by the invention are typically extruded small plastic strips, or small plastic strips cut from film that, seen in cross section, have a large width relative to their thickness and that can be woven. For example, the small strips are made of polypropylene, polyester, or polyethylene. Typically, the warp filaments used have a thickness of 50 μm to 200 μm, particularly 75 μm to 125 μm, in the full-thickness region, and about 25 μm to 75 μm, particularly 40 μm to 60 μm, in the partial-thickness region. Preferably, the thickness of the warp filaments in the partial-thickness region is about 50 percent of the thickness of the warp filaments in the full-thickness region. The width of the warp filaments is between 1.5 mm and 4 mm. Thus these warp filaments are of rectangular cross section.

The invention further provides that in the partial-thickness region, the warp filaments of reduced thickness can be wider than the warp filaments in the full-thickness region. This provides the benefit that fewer spools have to be equipped with the thinner warp filaments, which in turn saves on labor and makes the loom's creel easier to deal with. For example, the density of the warp filaments in the border area can be 4 to 8 warp filaments per centimeter, particularly 5 warp filaments per centimeter. These values and others mentioned above are of is course to be understood as guidelines and do not limit the scope of the present invention.

The method of making a web has according to the invention the steps of weaving warp filaments and weft filaments together into a textile web using warp filaments of a predetermined thickness in a predetermined central strip and warp filaments of lesser thickness in a selvage strip in the web. Then the woven web is subdivided longitudinally and warpwise along the selvage strip to form a pair of selvage-strip halves. Finally the selvage-strip halves to form a reinforced selvage.

This method is used for the production of the textile panels of the described shipping bags; however, it can also be used for the production of textile panels with reinforced selvage for any other purpose.

According to the method of this invention the partial-thickness region are fastened to the textile panel by hot melt adhesive, hot welding, ultrasound welding, or adhesive. As mentioned above, the longitudinal subdivision of the partial-thickness region can be done centrally, or at any other point in order to produce symmetrical or asymmetrical selvages. Folding the partial-thickness region over the full-thickness region can be done partially or entirely, with the result that the raised edge of the rolled-up textile panel is bigger or smaller.

The method of the invention further includes providing a coating to at least one side of the textile panel, which can cover the entire surface of the textile panel including the reinforced selvage, and in particular, can extend past the edge of the textile panel in form of an edge flange. For example, the reinforced selvage has a width of 1 cm to 3 cm, preferably 1.5 cm to 2.5 cm. Specifically, this means that prior to cutting, the partial-thickness region can typically have a width of 2 cm to 6 cm.

The warp filaments used are usually made of polypropylene, polyester, or polyethylene. In the partial-thickness region, they are typically about 50 percent thinner than in the full-thickness region.

The method of the invention further provides that in the partial-thickness region, the warp filaments of reduced thickness are wider than the ones in the full-thickness region. For example, in the partial-thickness region, 4 to 8, particularly 5 warp filaments of reduced thickness per centimeter are provided.

According to the invention the method further involves the step of seaming together panels made as described above to from a shipping bag.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
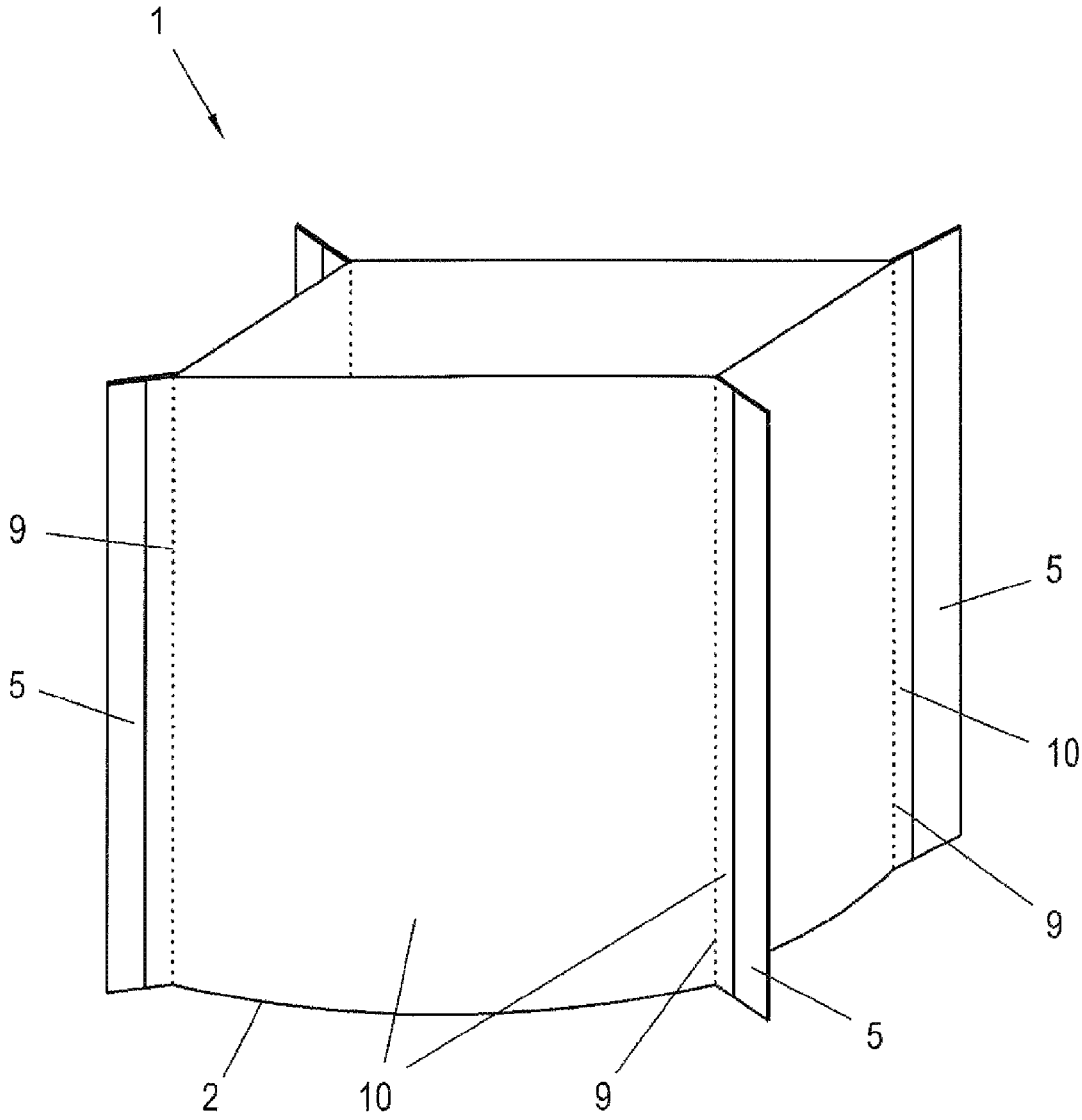
FIG. 1 is a small-scale schematic perspective view of a bag according to the invention.

FIG. 1 shows in perspective a first embodiment of a shipping bag 1 where carry handles or inserts, for example, are not shown for clarity of view. The shipping bag 1 comprises a plurality of woven-textile panels 2 secured together at edge seams 9. Each textile panel 2 has a full-thickness region 10 and a reinforced selvage 5. It can be clearly seen in the illustrated embodiment that the seam 9 extends inward past the reinforced selvage 5 into the full-thickness region 10 to maximize the strength of the joint. However, embodiments where the seam lies wholly in the reinforced selvage are also possible. The shipping bag shown in FIG. 1 can also be made of four sewn-together textile panels. However, the instant invention is not limited thereto, and also includes embodiments, which include a random number of textile panels. The bag 1 can also be made of three pieces, two short ones forming opposite sides and one long one that forms the other two sides and the floor.

Figure 2:
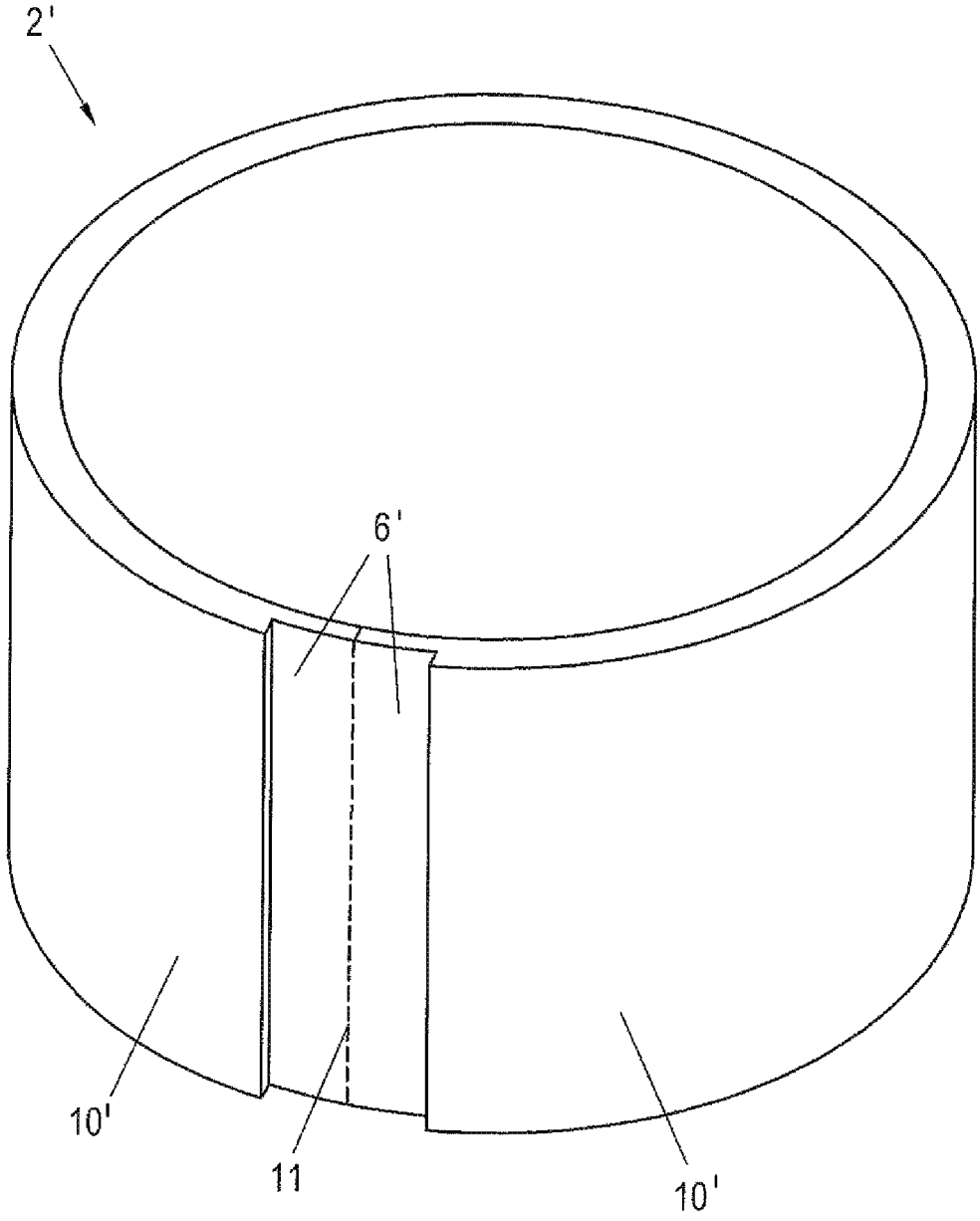
FIG. 2 is a large-scale schematic view illustrating the first steps of manufacture of the textile used to make the bag of FIG. 1.

FIG. 2 shows a perspective view of the textile panel, as formed immediately after production on a circular weaving loom. The illustration is purely schematic, and is not proportional in size. A textile tube 2' has the full-thickness region 10' and a narrower partial-thickness strip or region 6', here formed by using thinner warp filaments. After weaving, the textile panel 2 is longitudinal subdivided along a cut line 11 so that a planar or flat textile is obtained. Here, this longitudinal subdivision at the cut line 11 is done at the center of the longitudinally extending partial-thickness strip 6'. However, embodiments where the subdivision is done at a different point in the partial-thickness strip or region 6', or where the textile is cut at several lines are also feasible. At any rate, the longitudinal cut must be somewhere in the partial-thickness region 6' in order to achieve the desired benefits and comply with the method according to the invention.

Figure 3:
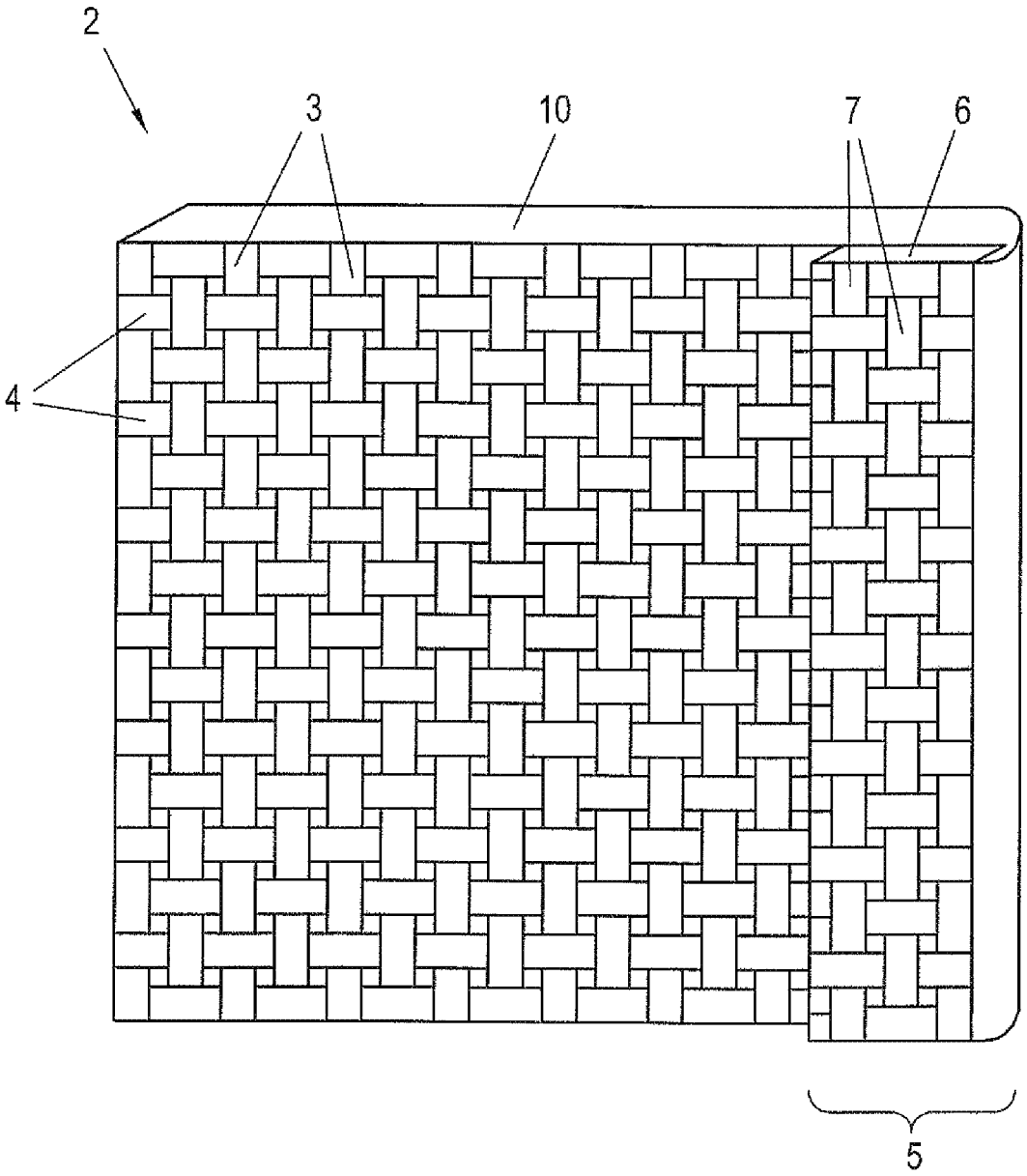
FIG. 3 is a large-scale view illustrating a detail of the textile in an intermediate stage of its manufacture.

FIG. 3 shows a perspective view of a detail of one of the textile panels 2. The panel 2 has a full-thickness region 10 formed by a section of the region 10' and the selvage formed by folding a partial-thickness region 6 formed by the strip 6' over the full-thickness region 10. The folded area forms the reinforced selvage 5. The textile panel 2 is formed by thick is warp filaments 3 and by weft filaments 4 in a standard weave. The actual weave used has no bearing on the instant invention. In the partial-thickness region 6, thin warp filaments 7 of reduced thickness are used instead of thick warp filaments 3. Therefore, the partial-thickness region 6 is of considerably smaller thickness, as can be seen in FIG. 3.

Figure 4:
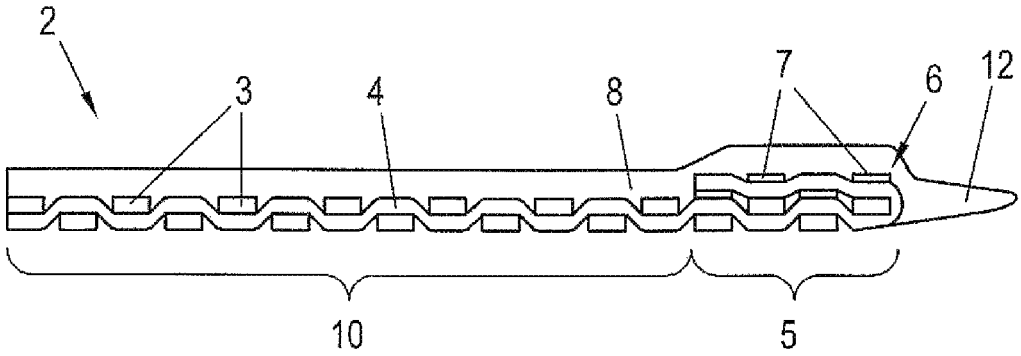
FIG. 4 is a cross section through the finished textile.

FIG. 4 shows the textile panel 2 according to the invention, in a cross section along one of the weft filaments 4. The textile panel 2 comprises the thick warp filaments 3, weft filaments 4, and thin warp filaments 7. The textile panel 2 can further be subdivided into the full-thickness region 10, the partial-thickness region 6, and the reinforced selvage 5 formed by folding the partial-thickness region 6 over the full-thickness region 10. It is noted that in FIGS. 3 and 4, the entire partial-thickness region 6 is folded over the full-thickness region 10, that is the fold is at the line subdividing these two regions. The textile panel 2 further has a coating 8 applied on one face of the finished textile panel 2, here the face turned inward in the finished bag. The reinforced selvage 5 is clearly raised on the coated face, which is the face over which it is folded, forming a wide welt at the selvage 5. Furthermore, according to the invention the coating extends outward in the plane of the panel 2 as thin edge flange 12 formed only by the coating 8, that is with no warp or weft filaments. Particular attention must be paid to the thin warp filaments 7 that are about 50 percent thinner than the thick warp filaments 3 in the full-thickness region 10. The partial-thickness region 6 can be fastened to the full-thickness region 10 by an adhesive, an adhesive film with the coating, or welding.

Figure 5:
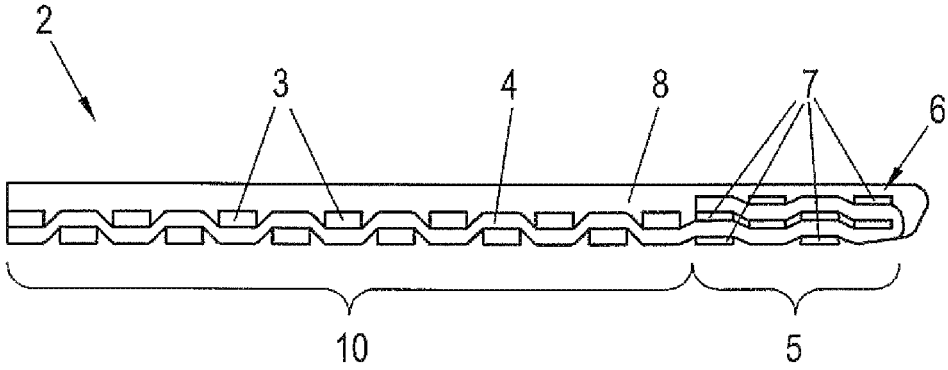
FIG. 5 is a view like FIG. 4 showing an alternative textile according to the invention.

FIG. 5 shows an additional illustrated embodiment of a textile panel 2 according to the invention in a transverse section along a weft filament 4, having warp filaments 3, weft filaments 4, and warp filaments of reduced thickness 7. In this embodiment, the textile panel 2 likewise comprises a full-thickness region 10 and a partial-thickness region 6 forming the reinforced selvage 5. In contrast to the embodiment of FIG. 4, the entire the partial-thickness region is not folded over the full-thickness region 10. Rather, the partial-thickness region 6 folded along its centerline, so one half if it is doubled over the other half. As a result, the reinforced selvage is of the same general thickness or only slightly thicker than the full-thickness region 10, with the result that after the coating 8 is applied, virtually no raised edge welt are formed. Here also the coating 8 does not extend the selvage 5 and form the thin flange 12.

Figure 6:
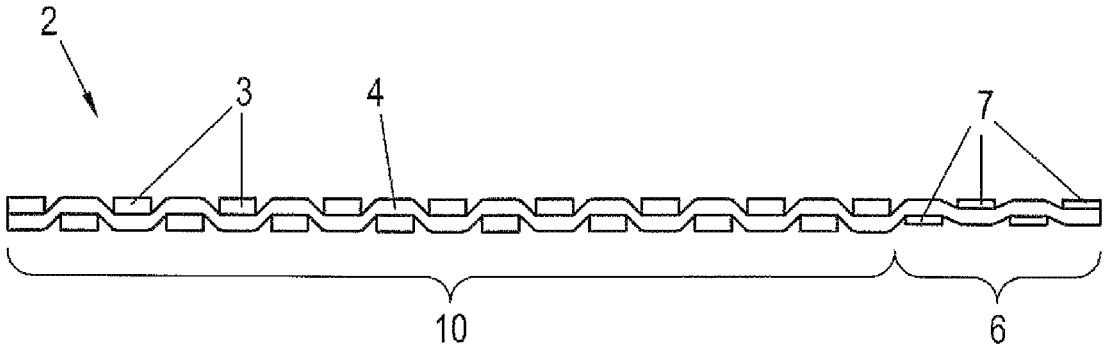
FIGS. 6, 7, and 8 are views showing successive steps between the FIG. 2 stage and the semifinished product of FIG. 3.
Figure 7:
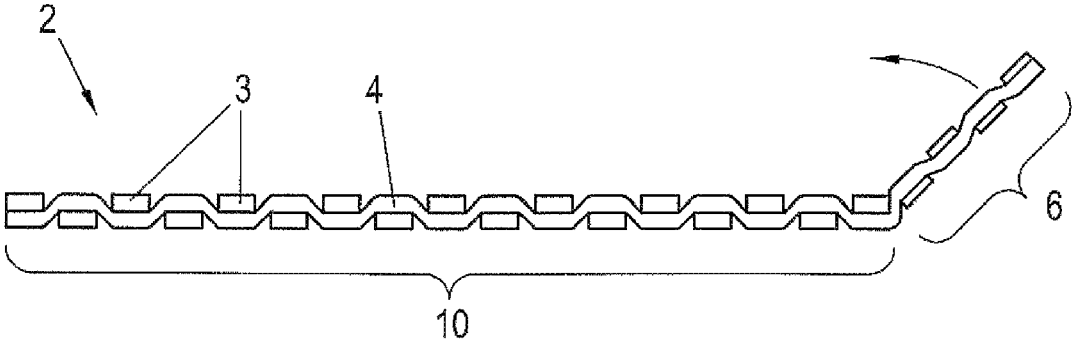
Figure 8:
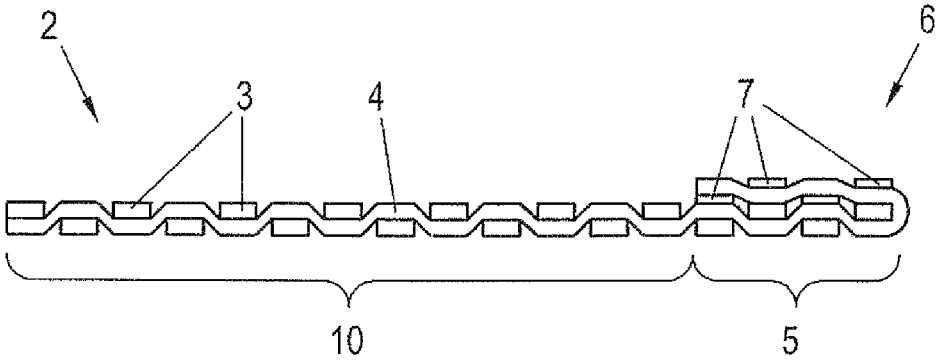

FIGS. 6 to 8 show in detail how the reinforced selvage 5 is formed. Starting with a textile panel 2 in FIG. 6 having warp filaments 3, weft filaments 4, and warp filaments of reduced thickness 7 in a partial-thickness region 6, the partial-thickness region 6 is folded over and fastened to the full-thickness region 10 as shown in FIG. 7 until the position of FIG. 8 is reached in which the reinforced selvage 5 is created. Again with as shown in FIG. 4 the partial-thickness region 6 folded over the full-thickness region 10. Subsequently, the textile panel 2 can be provided with a coating 8, at least on one face against which the region 6 was folded.

The present invention, however, is not limited to the illustrated embodiments of textile panels for shipping bags as shown in the figures, but also includes textile panels for any other application provided they have the described reinforced selvage. In addition, the validity of the invention is not limited to the discussed sizes of the warp filaments or weft filaments used. Furthermore, the invention is not limited to shipping bags that are sewn together but also includes structures made of textile panels interconnected in any other way, as long as the described reinforced selvage is used.

We claim:

1. A flexible shipping bag comprised of at least one panel having edges, the panel being formed of weft and warp filaments and having:

a central region of predetermined full thickness; and a selvage forming at least one of the respective edges and of a lesser thickness, the warp filaments in the central region being thicker than the warp filaments in the selvage, at least part of the selvage being folded over the central region.

2. The bag defined in claim 1, further comprising a bond adhering the folded over part of the selvage to the central region.

3. The bag defined in claim 2 wherein the bond is a weld or an adhesive.

4. The bag defined in claim 1, further comprising a coating on a face of the panel covering the central region and the folded-over selvage.

5. The bag defined in claim 4 wherein the coating extends as a filament-free flange past the selvage.

6. The bag defined in claim 1, wherein the central region has a thickness of 1 cm to 3 cm and the selvage has a thickness of 1.5 cm to 2.5 cm.

7. The bag defined in claim 1, wherein the bag is formed by a plurality of the panels and further comprises respective seams attaching the edges of the panels together and each extending from a respective selvage into the respective central region.

8. The bag defined in claim 7 wherein each of the seams is between 17 mm and 25 mm wide.

9. The bag defined in claim 1 wherein the filaments are of polypropylene, polyester, or polyethylene.

10. The bag defined in claim 1 wherein the warp filaments of the central region have a diameter of 50 μm to 200 μm and the warp filaments of the selvage have a diameter of 25 μm to 75 μm.

11. The bag defined in claim 1 wherein the warp filaments of the selvage are wider than the warp filaments of the central region.

12. The bag defined in claim 1 wherein the warp filaments of the selvage are about 50% as thick as the warp filaments of the central region.

13. A flexible shipping bag comprised of at least one panel having edges, the panel being formed of weft and warp filaments and having:

a central region of predetermined full thickness; and a selvage forming at least one of the respective edges and of a lesser thickness, the warp filaments in the central region being thicker than the warp filaments in the selvage, there being 4 to 8 warp filaments/cm.

14. A method of making a web comprising the steps of:

weaving warp filaments and weft filaments together into a textile web;

using warp filaments of a predetermined thickness in a predetermined central strip and warp filaments of lesser thickness in a selvage strip of the textile web;

subdividing the textile web longitudinally and warpwise along the selvage strip to form a pair of selvage-strip halves;

folding over the selvage-strip halves to form a reinforced selvage, the warp filaments of the selvage being wider than the warp filaments of the central region; and bonding down the folded-over selvage-strip halves.

15. The method defined in claim 14, further comprising the step of applying a coating over the central strip and the folded-over selvage edges.

16. The method defined in claim 15 wherein the coating forms an edge welt at the selvage edges.

17. The method defined in claim 14 wherein the selvage has a width of between 1 cm and 3 cm.

18. The method defined in claim 14 wherein the filaments are of polypropylene, polyester, or polyethylene.

19. The method defined in claim 14 wherein the warp filaments of the central region have a diameter of 50 μm to 200 μm and the warp filaments of the selvage have a diameter of 25 μm to 75 μm.

20. The method defined in claim 14 wherein in the selvage there are 4 to 8 warp filaments/cm.

21. A method of making a web comprising the steps of:

weaving warp filaments and weft filaments together into a textile web;

using warp filaments of a predetermined thickness in a predetermined central strip and warp filaments of lesser thickness in a selvage strip of the textile web;

subdividing the textile web longitudinally and warpwise along the selvage strip to form a pair of selvage-strip halves;

folding over the selvage-strip halves to form a reinforced selvage, the warp filaments of the selvage being about 50% as thick as the warp filaments of the central region; and bonding down the folded-over selvage-strip halves.

* * * * *